US005534976A

United States Patent [19]

Kim

[11] Patent Number: 5,534,976

[45] Date of Patent: Jul. 9, 1996

[54] METHOD FOR ELIMINATING A PAPER JAM OF AN IMAGE FORMING SYSTEM AND APPARATUS THEREFOR

[75] Inventor: Kyung-Yeol Kim, Seoul, Rep. of Korea

[73] Assignee: SamSung Electronics Co., Ltd., Suwon, Rep. of Korea

[21] Appl. No.: 202,971

[22] Filed: Feb. 8, 1994

[30] Foreign Application Priority Data

Oct. 20, 1993 [KR] Rep. of Korea ..... 21773/1993

[51] Int. Cl.[6] ..... G03G 21/00

[52] U.S. Cl. ..... 355/207; 355/208

[58] Field of Search ..... 355/207, 208, 355/308, 316

[56] References Cited

U.S. PATENT DOCUMENTS

| | | | |
|---|---|---|---|
| 4,260,236 | 4/1981 | Tsuda et al. | 355/274 |
| 4,530,494 | 7/1985 | Saitoh et al. | 271/9 |
| 4,572,652 | 2/1986 | Tada et al. | 355/206 |
| 4,858,042 | 8/1989 | Ito et al. | 360/96.5 |
| 4,861,017 | 8/1989 | Yamamoto et al. | 271/258 |
| 4,937,622 | 6/1990 | Makiura | 355/206 |
| 4,944,136 | 7/1990 | Gough | 53/493 |
| 4,951,090 | 8/1990 | Matsumoto et al. | 355/200 |
| 5,026,035 | 6/1991 | Martinez Sanz et al. | 270/45 |
| 5,164,770 | 11/1992 | Furuichi et al. | 355/206 |
| 5,253,015 | 10/1993 | Morita et al. | 355/210 |
| 5,384,624 | 1/1995 | Kajiwara | 355/207 |

FOREIGN PATENT DOCUMENTS

| | | |
|---|---|---|
| 59-22834 | 2/1984 | Japan . |
| 59-124640 | 7/1984 | Japan . |
| 60-22138 | 2/1985 | Japan . |
| 62-277060 | 2/1987 | Japan . |

*Primary Examiner*—Nestor R. Ramirez
*Attorney, Agent, or Firm*—Robert E. Bushnell

[57] ABSTRACT

A system for automatically eliminating a paper jam in an electrophotographic device may be initiated by removing and re-inserting a paper cassette subsequent to the occurrence of the paper jam. If the paper cassette is removed and inserted, a paper jam eliminating mode is implemented to eliminate the paper jam. In one implementation, a controller detects entry and exit of the paper as the paper is propelled by a plurality of rollers to travel between spaced-apart locations along a path normally taken by the paper as the paper travels through the device, makes a determination of the occurrence of a paper jam due to an interruption of the travel of the paper along the path on a basis of any delay in the entry and exit, monitors a first sensor to detect removal and reinsertion of said paper cassette subsequent to the occurrence, and upon detection of removal and reinsertion of said paper cassette subsequent to the occurrence, eliminates the interruption by driving the plurality of rollers to expel paper from said conveyance path.

20 Claims, 3 Drawing Sheets

METHOD FOR ELIMINATING A PAPER JAM OF AN IMAGE FORMING SYSTEM AND APPARATUS THEREFOR

BACKGROUND OF THE INVENTION

The present invention relates to an image forming system for recording images using electrophotographic developing processes, and more particularly, to a method and apparatus for automatically eliminating a paper jam.

Electrophotographic developing processes are widely used in copiers, printers, facsimile machines and other instruments to generate an image corresponding to an electrical signal. An example of an electrophotographic developing printer is a laser beam printer (hereinafter "LBP"). The general structure of an LBP using the electrophotographic developing process is disclosed in detail in U.S. Pat. No. 5,002,266 entitled "*Sheet Feed Apparatus for Image Forming System*" issued to Kikuchi et al. on 26 Mar. 1991.

While modern devices, such as the aforementioned printer, greatly enhance our ability to transfer and duplicate information, they also bestow the misfortune of an occasional malfunction. Although some problems are more prevalent than others, one problem that seems to frequently occur is the "paper jam." Paper jams are always inconvenient; however, if they happen at the wrong time, they can cause severe problems in office administration. Therefore, it is greatly desired that when a paper jam occurs, the jam be quickly eliminated. While the prior art teaches a variety of ways in which paper jams can be cleared from electrophotographic devices, these methods have disadvantages of being inconvenient and detrimental to the mechanical health of the device.

One primary technique for automatically eliminating a paper jam is disclosed in detail in Korea Patent application No. 93-9002, assigned to the same assignee as the present invention. With this technique, a circuit controller displays the occurrence of the jam on an operational panel and checks whether the unit's cover is open or closed. The open or closed state of the unit's cover is detected by a sensor. In order to automatically eliminate the paper jam, the user selects a paper jam eliminating mode for performing a paper jam correction operation by opening and closing the unit's cover. Then, since the sensor is consequently switched either on/off or off/on, the circuit controller senses the paper jam eliminating mode through a sensor input. The circuit controller then rotates a fixing roller by activating an engine driving motor which further rotates both a pickup roller and the register rollers. Therefore, paper in the paper conveyance path is ejected, and the paper jam is eliminated. Thereafter, the circuit controller sequentially stops operation of each portion of the engine and activates a standby mode. A control circuit that performs these operations is disclosed in Korean Patent application No. 92-11243, assigned to the same assignee as the present invention.

One problem with the foregoing method is that the opening and closing of the unit's cover causes external light to enter into the interior of the printer. This often causes the photosensitive drum and developing unit to be unnecessarily exposed to light so that their voltage potential varies, and picture quality ultimately deteriorates. Also, since the toner within the developing unit is dispersed in the interior of the printer, internal items such as the photosensitive drum, charger, developing unit, laser scanner unit and laser reflecting mirror become polluted, thus causing subsequent malfunction of the unit. Furthermore, since the unit's cover may have to be frequently opened and closed, the life of the printer is shortened due to vibrations and shock to the printer that accompany opening and closing of the cover.

Another attempt at a paper jam removal method is disclosed in U.S. Pat. No. 4,260,236 entitled *Electrophotographic Apparatus* issued to Tsuda et al. This reference discloses a record paper detector for detecting a paper jam. Once a jam is detected, a paper jam signal is generated to stop rotation of the photosensitive drum and to move a transfer roller away from the photosensitive drum to facilitate manual removal of the jammed paper. This method, aside from being inconvenient, can require an opening of the unit cover which thereby exposes the drum to exterior light and consequently risks deterioration of the photosensitive drum and developing unit as mentioned above.

SUMMARY OF THE INVENTION

Accordingly, it is therefore one object of the present invention to provide an improved apparatus and process for clearing jams of sheets of paper within image forming systems.

It is another object to provide a simplier process and apparatus for removing a paper jam along a paper conveyancing path of an image forming system.

It is yet another object to provide a more practical process and apparatus for clearing a paper jam occurring along the paper conveyancing path of an image forming system.

It is still another object to provide a process and apparatus for reducing the exposure of light and the occurrence of vibrations and shock generated when correcting a paper jam along the paper conveyancing path of an image forming system.

It is still yet another object to provide a method and apparatus for correcting a paper jam in an image forming system without the necessity of opening and closing the cover of the unit.

It is a further object of the present invention to provide a method and apparatus enabling correction of a paper jam in an image forming system by removing and re-inserting a paper cassette into the unit.

These and other objects may be achieved in accordance with one aspect of the present invention by, upon determination of the likelihood of an occurrence of a paper jam along the paper conveyancing path of all image forming unit, then making a determination about whether a paper cassette has been removed and re-inserted. If the paper cassette has been removed and re-inserted, a paper jam eliminating mode is implemented to thereby correct a paper jam within the

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
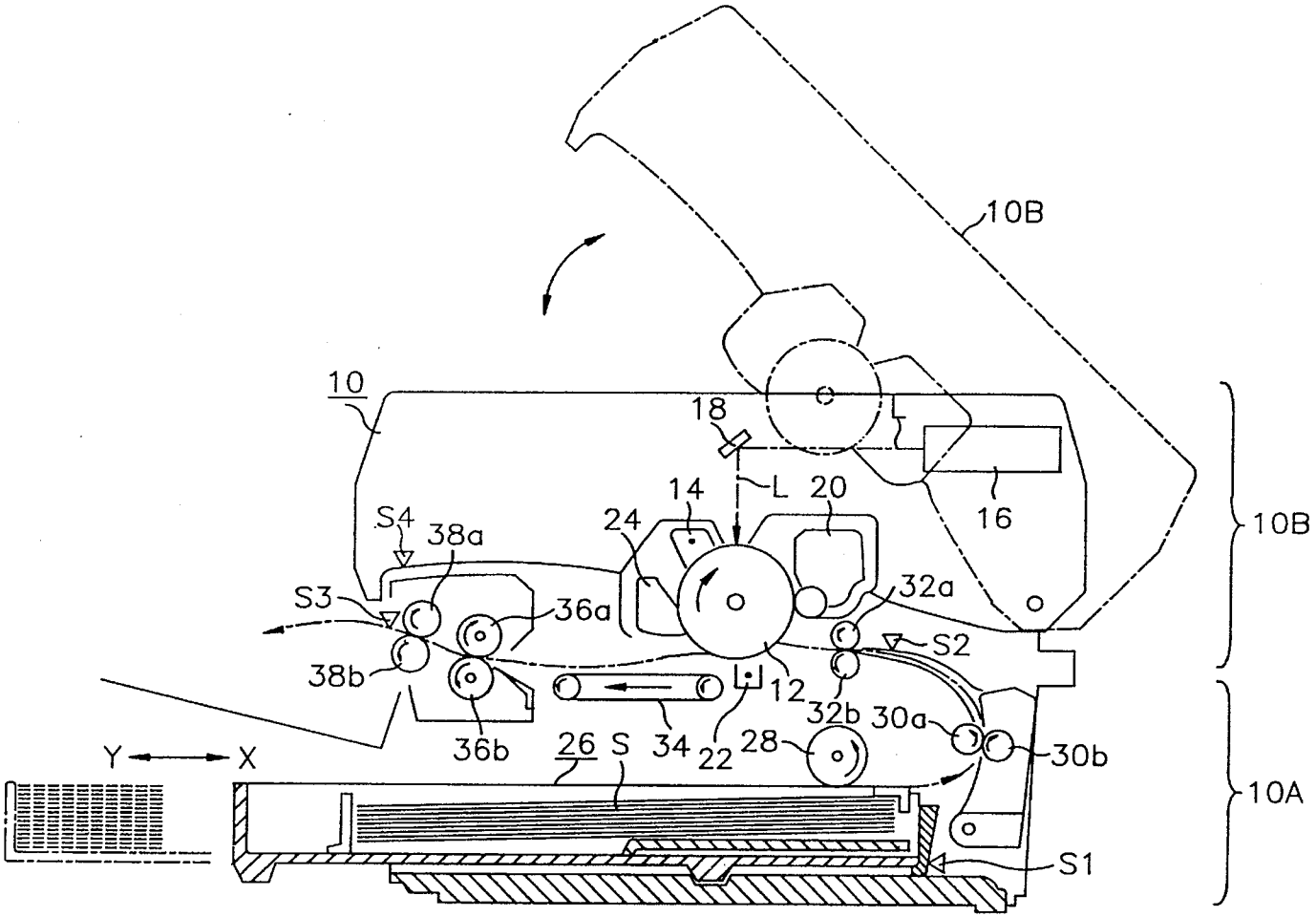
(PRIOR ART) FIG. 1
FIG. 1 is a longitudinal side view showing the print mechanism of a representative design for an electrophotographic developing unit such as a printer.

Turning now to the drawings, the printer shown in FIG. 1 includes a housing 10 having a body 10A and a cover 10B. The cover 10B is pivotally mounted on body 10A and can be opened and closed from the body 10A. A charger 14 forms a uniform charge on a photosensitive drum 12. A laser scanner unit 16 generates a laser beam L corresponding to image data and exposes the photosensitive drum 12 through a laser reflecting mirror 18, thereby forming an electrostatic latent image. A developing unit 20 transmits toner to the electrostatic latent image formed on the photosensitive drum 12. A pickup roller 28 (also known as a feed roller) picks up paper S stacked in a paper cassette 26. Conveyor rollers 30a and 30b convey the paper picked up by the pickup roller 28 to register rollers 32*a* and 32*b*. The register rollers 32*a* and 32*b* arrange the paper conveyed by the pickup roller 28 and conveyor rollers 30*a* and 30*b*. A transfer unit 22 transfers the toner formed on photosensitive drum 12 to the paper. A cleaner 24 removes the residual toner from the surface of the photosensitive drum 12 after toner image transfer. A conveyor belt 34 then conveys the paper from transfer unit 22 to fixing rollers 36*a* and 36*b*. The fixing rollers 36*a* and 36*b* subsequently fix the toner on the paper. Delivery rollers 38*a* and 38*b* ultimately eject the image-formed paper to the exterior of the printer.

In a typical printer, sensors for determining the operational state of each portion of the printer and the conveyance state of the paper are installed. FIG. 1 shows four sensors S1–S4 for performing such functions. The first sensor S1, installed to contact an end of the paper cassette 26 on the inside of the body 10A, senses the removal and insertion state of the paper cassette 26. The second sensor S2, installed along a paper conveyance path between the conveyor rollers 30*a* and 30*b* and the register rollers 32*a* and 32*b*, senses the conveyance state of the paper conveyed from the paper cassette 26 to the register rollers 32*a* and 32*b*. The third sensor S3, installed along a paper delivery path extending from the delivery rollers 38*a* and 38*b*, senses the delivery state of the paper. The fourth sensor S4 installed on a side of the cover 10B opposite from body 10A, senses the opening and closing state of the cover 10B.

Figure 2:
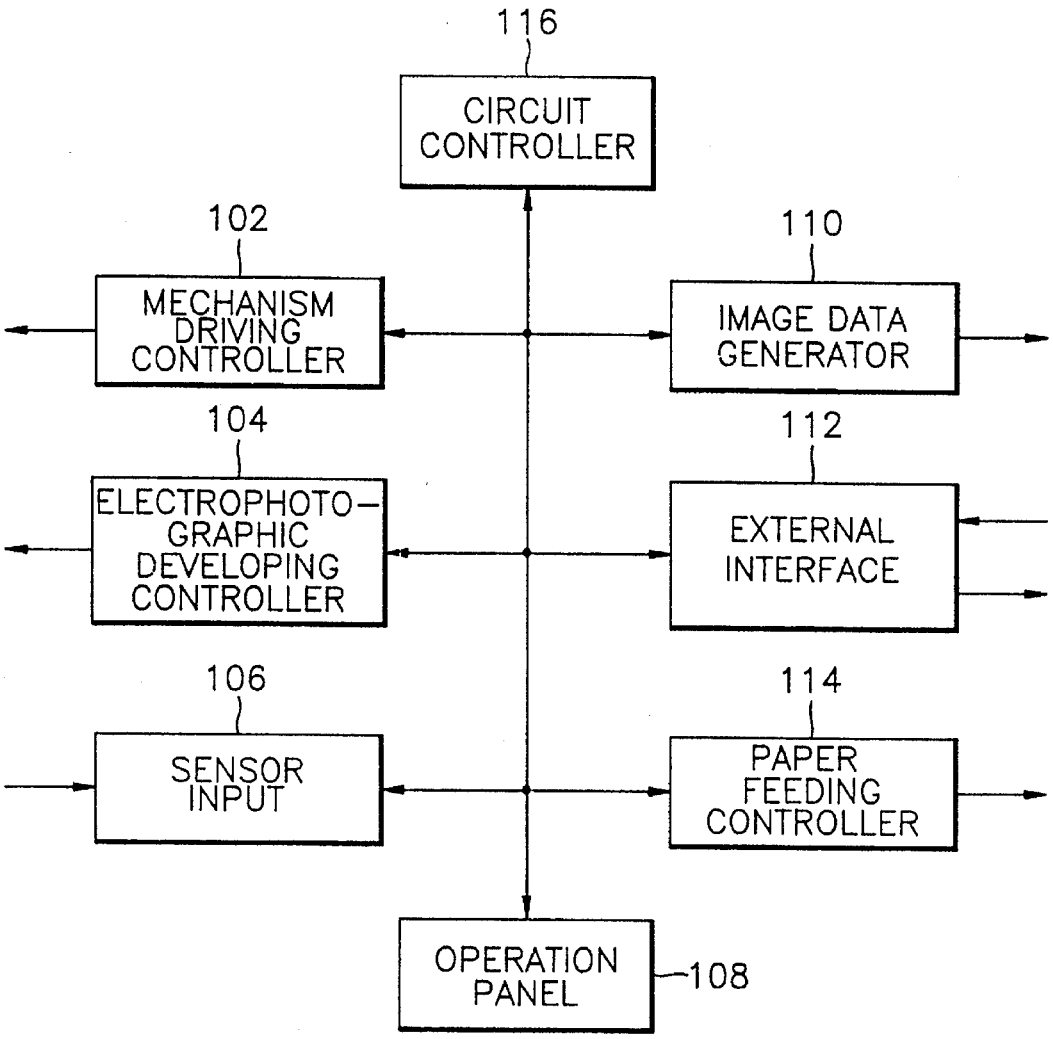
(PRIOR ART) FIG. 2
FIG. 2 is a block diagram showing an engine control circuit of a representative design for an electrophotographic developing unit.

FIG. 2 shows a block diagram of a control circuit for controlling an engine of the printer of FIG. 1. In FIG. 2, a known operation panel 108 is shown. This panel however, is incorporated into the control circuit that enables the following components to perform their intended functions. A mechanism driving controller 102 controls mechanical parts including the various rollers shown in FIG. 1. An electrophotographic developing controller 104 controls the development of an electrophotograph. A sensor input 106 receives the outputs of various sensors, including the four sensors S1–S4 of FIG. 1, and applies the outputs to a circuit controller 116. The operation panel 108, having a plurality of keys and a display unit, applies key data corresponding to a key input to the circuit controller 116, and displays the operational state of the printer under control of circuit controller 116. An image data generator 110 generates image data and transmits the image data to the laser scanner unit 16. An external interface 112 interfaces signals received from an external control system (not shown) and generated thereto. A paper feeding controller 114 controls the feed of paper. The circuit controller 116 carries out various functions of the printer by controlling each portion of the printer, including the mechanism driving controller 102, electrophotographic developing controller 104, image data generator 110, external interface 112 and paper feed controller 114 in response to input signals from the sensor input 106, operation panel 108 and external interface 112. Typically, the circuit controller 116 uses a microcomputer and implements an internal program to control each portion of the printer.

A brief description of a printing process useful in understanding the present invention will now be given with reference to FIGS. 1 and 2.

When the circuit of FIG. 2 begins operation, the circuit controller 116 controls the electrophotographic developing controller 104 to initialize the printer to a printing state and to execute a standby mode for checking whether or not a print command is received from the control system through external interface 112. During the standby mode, the circuit controller 116 begins printing in response to the print command. The circuit controller 116 operates the photosensitive drum 12, charger 14, developing unit 20, transfer unit 22, laser scanner unit 16, and other components by driving an engine driving motor. The engine driving motor drives the photosensitive drum 12, charger 14, developing unit 20, transfer unit 22, laser scanner unit 16, and other components. Paper is then fed from paper cassette 26 to implement a printing operation. If the printing operation is terminated, circuit controller 116 stops operation of the engine driving motor and again executes the standby mode.

The printer and engine control circuit to which the present invention is directed may be the same as those of FIGS. 1 and 2, respectively, and reference numerals and symbols are the sable.

In one embodiment constructed according to the principles of the present invention, a paper jam is generally sensed by checking the time it takes for paper to pass between second and third sensors S2 and S3 from pickup roller 28. That is, if the paper does not pass between the second and third sensors S2 and S3 within a given period of time, a paper jam is deemed to have occurred. In the event of a paper jam during printing, a determination is made as to whether the paper cassette has been removed and re-inserted, and the paper jam eliminating mode may be conveniently initiated by the removal and re-insertion of the paper cassette. The paper jam is thereby eliminated by the implementation of the paper jam eliminating mode.

Figure 3:
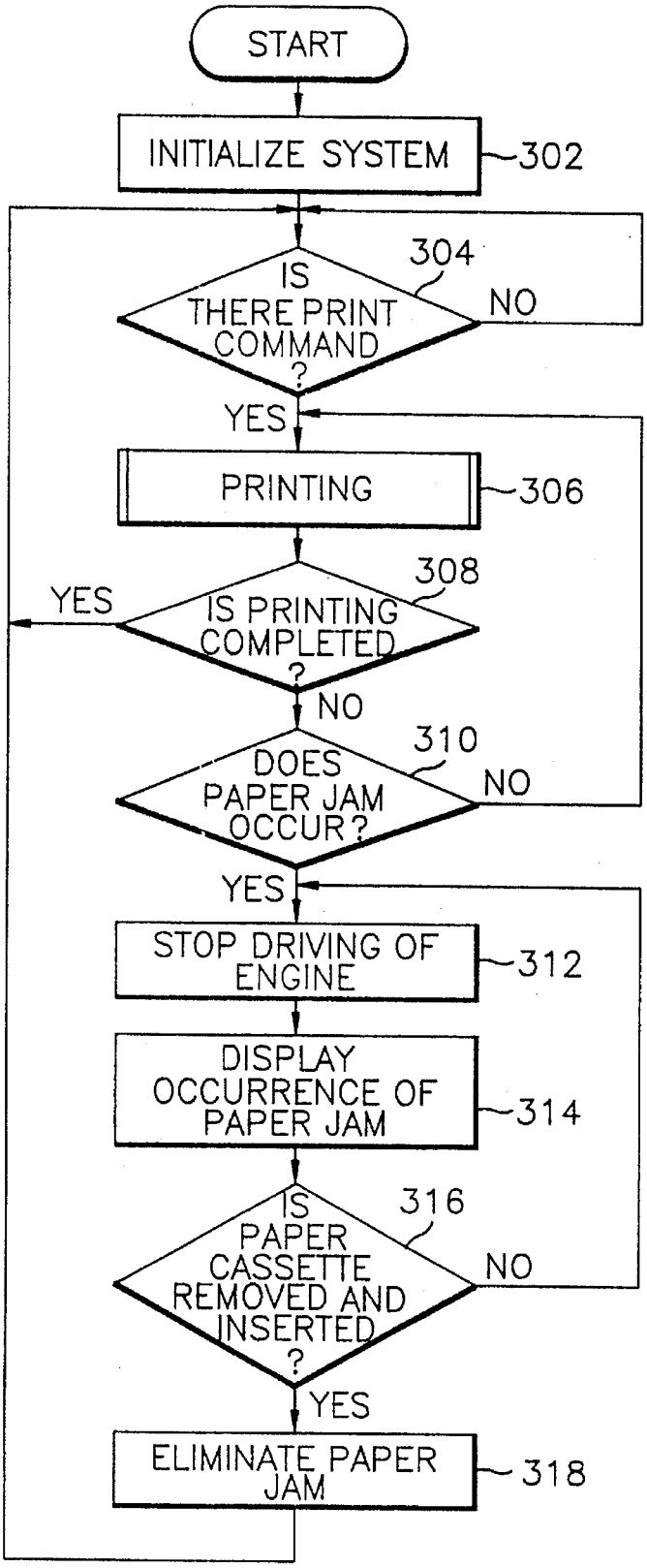
FIG. 3 is a flow chart showing a paper jam eliminating process performed according to the principles of the present invention.

An example of the paper jam eliminating process performed according to the principles of the present invention will now be described with reference to FIGS. 1, 2 and 3.

When the circuit of FIG. 2 begins operation, circuit controller 116 initializes the printer at step 302 to a printable state by controlling electrophotographic developing controller 104. At step 304, during a standby mode a determination is made about whether or not a print command from the control system through external interface 112 has been initiated. If the print command has been initiated during the standby mode, circuit controller 116 begins, at step 306, to print in response to the print command. In this case, circuit controller 116 sequentially operates the photosensitive drum 12, charger 14, developing unit 20, transfer unit 22 and laser scanner unit 16 by driving the engine driving motor. Then, the paper is fed from the paper cassette 26 and the printing operation is executed.

At step 308, a determination is made as to whether or not printing is completed. If printing has not been completed but is determined to be proceeding sensors S2, S3 are checked in step 309, and a determination is then made at step 310 to see if a paper jam has occurred by, for example, monitoring sensors S2, S3 to detect whether a sheet of paper has passed between sensors S2, S3 within a given period of time. If a paper jam has not occurred, the printing proceeds continuously. If a paper jam is however, determined to have occurred, the engine is stopped at step 312, and indication of a paper jam is displayed, at step 314, on the operation panel 108. At step 316, a determination is made about whether or not the paper cassette 26 has been removed and re-inserted after monitoring an electrtical signal provided by first sensor S1 in step 315. Typically, an electrical signal provided by first sensor S1 will vary in dependence upon the presence or absence of paper cassette 26, thereby enabling circuit controller 116 to readily determine whether paper cassette 26 is present, is absent, or is removed and re-inserted. Typically, removal and insertion of the paper cassette 26 is sensed by variation of a signal generated by first sensor S1. Therefore, in the preferred embodiment of the present invention, the paper jam eliminating mode is selected not by opening and closing cover 10B, but by removing and re-inserting paper cassette 26. If a user removes paper cassette 26 (i.e. moving it in the direction of an arrow Y) and then re-inserts it (i.e. moving it in the direction of an arrow X) after checking the state of paper within paper cassette 26, circuit controller 116 rotates fixing rollers 36*a*, 36*b* by driving the engine driving motor, thereby also rotating pickup roller 28 and register rollers 32*a* and 32*b*. Since paper in the conveyance path is thereby ejected, the paper jam is eliminated, in step 318. Thereafter, circuit controller 116 sequentially stops operation of each portion of the engine and again reverts to a standby mode.

At step 308, if the printing has been completed, operation of each portion of the engine is sequentially stopped and the unit reverts to the standby mode at step 304.

In essence, in an implementation of the embodiment described, the controlling circuit detects entry and exit of the paper as the paper is propelled by a plurality of rollers to travel between spaced-apart locations along a path normally taken by the paper as the paper travels through the device, makes a determination of the occurrence of a paper jam due to an interruption of the travel of the paper along the path on a basis of any delay in the entry and exit, monitors a first sensor to detect removal and reinsertion of the paper cassette subsequent to the occurrence, and upon detection of removal and reinsertion of the paper cassette subsequent to the occurrence, eliminates the interruption by driving the plurality of rollers to expel paper from the conveyance path.

Consequently, if a paper jam occurs, the paper jam eliminating mode automatically eliminating the jam is conveniently and easily selected by removing and re-inserting the paper cassette 26, not by opening and closing the cover 10B. Hence, external light does not enter the interior of the printer, and vibrations and shock to the printer caused by the opening and closing of the cover 10B are greatly reduced. As a result, problems such as deterioration of picture quality due to unnecessary exposure of photosensitive drum 12, developing unit 20, and other components, and potential malfunction of portions of the printer due to the dispersion of toner can be overcome. Moreover, since there is no need to frequently open and close the cover 10B, the operative life of the printer is increased. Furthermore, the printer is more convenient to use since the paper jam eliminating mode is automatically set only by removing and re-inserting the paper cassette 26.

The removal of paper cassette 26 concomitantly enables the user to simultaneously check the state of paper S remaining within cassette 26 as an integral part of the paper jam correcting process. Many printers using conventional methods for detecting paper jams (e.g. paper jams are detected when paper does not pass through the second sensor S2 after rotating the pickup roller 28 until a given period of time elapses) are without a sensor to detect the presence or absence of paper. In such printers, if a paper jam occurs during printing when there is no paper within the paper cassette 26, the present invention has a clear advantage since a paper jam and the presence or absence of paper are simultaneously checked by removing paper cassette 26.

While the above description and the accompanying figures are considered to represent the preferred embodiment of the present invention, it will be apparent to those skilled in the art that various changes and modifications may be made therein without departing from the spirit and scope of the present invention as defined in the appended claims, and that it may also be possible to apply the present invention to a copier, LPH (LED print head) printer, plain paper facsimile or any device using the electrophotographic developing process without departing from the metes and bounds of the present invention. Additionally, it may be noted that although the embodiment provided only a single paper cassette and a single path from that cassette to the delivery rollers, the foregoing principles may be accommodated in a unit accepting delivery of paper from a plurality of cassettes, with the paths from each of the cassettes merging into a single path prior to the photosensitive drum. In such a multi-cassette unit, each tray would have a different corresponding first sensor, while a paper cassette selection switch would also determine which first sensor would be read in step 315 during occurrence of a paper jam, as well as which pickup roller would be driven in step 318 during elimination of the paper jam.

As may be apparent from the aforementioned description, the paper jam eliminating mode is set by removing and re-inserting a paper cassette, without suffering the necessity of opening and closing the printer cover. Since the exposure of external light is prevented and vibrations and shock are reduced, deterioration of picture quality and potential malfunctions of the printer can be prevented, and the operative life of the printer can thus be increased.

What is claimed is:

1. A method for eliminating a paper jam in response to activation of a paper jam eliminating mode in an electrophotographic developing device having means for sensing removal and insertion of a paper cassette, said method comprising the steps of:

determining whether said paper cassette is removed and re-inserted upon occurrence of said paper jam; and activating said paper jam eliminating mode in response to said paper cassette being removed and re-inserted to eliminate said paper jam by rotating a plurality of rollers positioned along a paper conveyance path within said device and expelling paper causing said paper jam to an exterior of said device.

2. The method as claimed in claim 1, further comprised of concluding, during said step of determining, said paper jam has occurred when said paper is not conveyed between two spaced-apart locations along said paper conveyance path within a predetermined period of time during printing of information onto paper by said electrophotographic device.

3. The method as claimed in claim 1, further comprised of displaying a variable visual representation indicative of said paper jam upon said occurrence of said paper jam.

4. The method as claimed in claim 1, further comprised of detecting said paper jam by sensing a conveyance state of paper along said paper conveyance path during printing.

5. A method for detecting and eliminating a paper jam in an electrophotographic developing printer having means for sensing removal and insertion of a paper cassette and means for sensing a conveyance state of paper along a paper conveyance path within said printer, said method comprising the steps of:

determining whether said paper jam has occurred by sensing said conveyance state of paper along said paper conveyance path during printing;

stopping an engine of said printer from being driven when said paper jam is determined to have occurred;

after said paper jam is determined to have occurred, determining whether said paper cassette is removed from and re-inserted into said electrophotographic developing printer; and eliminating said paper jam upon sensing said removal and re-insertion of said paper cassette into said electrophotographic developing printer by rotating a plurality of rollers positioned along said paper conveyance path and expelling paper along said paper conveyance path causing said paper jam to an exterior of said printer.

6. The method as claimed in claim 5, further comprised of determining that said paper jam has occurred when paper introduced into said paper conveyance path is not fed between two spaced-apart locations along said paper conveyance path within a predetermined period of time during said printing.

7. The method as claimed in claim 5, further comprised of displaying a variable visual representation of said occurrence of said paper jam when said paper jam is determined to have occurred.

8. An apparatus for eliminating a paper jam in an electrophotographic developing printer, said apparatus comprising:

means for checking whether a paper cassette is removed from and then re-inserted back into said printer upon occurrence of a paper jam along a paper conveyance path within an electrophotographic developing printer; and memos for eliminating said paper jam in response to said paper cassette being removed from and then re-inserted into said printer by rotating a plurality of rollers positioned along said paper conveyance path within said printer and thereby expelling paper causing said paper jam to an exterior of said printer.

9. The apparatus as claimed in claim 8, further comprised of means for determining that said paper jam has occurred when said paper is not conveyed between two spaced-apart locations along said paper conveyance path within a predetermined period of time during printing of information onto said paper by said electrophotographic printer.

10. The apparatus as claimed in claim 8, further comprising means for providing a variable visual representation indicative of said occurrence of said paper jam.

11. The apparatus as claimed in claim 8, further comprising means for determining whether said paper jam occurs by sensing a conveyance state of paper along said paper conveyance path during printing.

12. An apparatus for eliminating a paper jam in an electrophotographic developing printer, said apparatus comprising:

a paper cassette for serially dispensing paper to receive printed images from said printer during an electrophotographic process, said paper cassette being configured to be removed from and re-inserted into said printer;

means for interrupting said electrophotographic process of said printer after said paper jam has occurred, and then determining whether said paper cassette has been removed from and then re-inserted into said printer; and means for eliminating said paper jam in response to determining that said paper cassette has been removed from and then re-inserted into said printer by rotating rollers positioned along a paper conveyance path within said printer to expel paper causing said paper jam to an exterior of said printer.

13. The apparatus as claimed in claim 12, further comprised of means for determining that said paper jam has occurred when said paper is not conveyed between two spaced-apart locations along said paper conveyance path within a predetermined period of time during said electrophotographic process.

14. The apparatus as claimed in claim 12, further comprising means for providing a variable visual representation indicative of said paper jam.

15. The apparatus as claimed in claim 12, further comprising means for checking whether said paper jam occurs by sensing a conveyance state of said paper along said paper conveyance path during said electrophotographic process.

16. A method for detecting and eliminating a paper jam in an electrophotographic developing printer, said method comprising:

withdrawing paper from a paper cassette by rotating a pickup roller in contact with said paper and transferring said paper into a path conveying the paper through the printer;

passing said paper past first sensing means positioned along said paper path and initiating a timing operation, said timing operation being initiated when said paper passes by said first sensing means;

making a determination that said paper jam has occurred when said timing operation indicates that a predetermined period of time has elapsed;

stopping an engine of said printer from being driven when said paper jam has occurred;

after making said determination that a paper jam has occurred, checking whether said paper cassette has been removed and re-inserted; and eliminating said paper jam upon sensing said removal and insertion of said paper cassette by rotating a plurality of rollers within said conveyance path.

17. The method as claimed in claim 16, further comprised of displaying a variable visual representation indicating that said paper jam has occurred.

18. An electrophotographic developing printer, comprising:

a paper cassette for accommodating a plurality of sheets of paper to receive printed images from said printer during an electrophotographic process;

a plurality of rollers for withdrawing the sheets of paper from said paper cassette and guiding the sheets of paper through a conveyance path where said electrophotographic process occurs;

first sensing means for detecting removal and insertion of said paper cassette from and into said printer;

second and third sensing means for sensing passage of paper at spaced-apart locations along said conveyance path by detecting entry and exit times of the sheets of paper into and from said conveyance path, respectively, said second and third sensing means determining an occurrence of a paper jam within said printer when a difference between said entry and exit times exceeds a predetermined value; and controlling means for detecting entry and exit of the paper as the of paper travels between said spaced-apart locations, for making a determination of the occurrence of an interruption of travel of the paper along said path on a basis of said entry and exit times, for monitoring said first sensor to detect removal and re-insertion of said paper cassette subsequent to said occurrence, and upon detection of said removal and re-insertion of said paper cassette subsequent to said occurrence for eliminating said interruption by driving said plurality of rollers to expel paper from said conveyance path.

19. The apparatus as claimed in claim 18, further comprising means for providing a variable visual representation indicative of said occurrence.

20. A method for detecting and eliminating a paper jam in an electrophotographic developing printer, said method comprising the steps of:

withdrawing paper from a paper cassette by rotating a pickup roller in contact with the paper and transferring the paper into a paper path conveying the paper through said printer;

moving the paper past a first sensor positioned along said paper path, said first sensor detecting passage of the paper as the paper passes by the first sensor;

making a determination that said paper jam has occurred when a second sensor positioned along said path and spaced apart from said first sensor along said paper path fails to detect passage of the paper within a predetermined period of time after said first sensor detects the passage of the paper;

after making said determination that said paper jam has occurred, checking whether said paper cassette has been removed from said printer and then re-inserted back into said printer; and eliminating said paper jam upon sensing that said paper cassette has been removed and re-inserted by rotating a plurality of rollers positioned along said paper path and expelling the paper causing said paper jam to an exterior of said printer.

* * * * *